United States Patent [19]

Fox et al.

[11] Patent Number: 4,459,576

[45] Date of Patent: Jul. 10, 1984

[54] TOROIDAL TRANSFORMER WITH ELECTROSTATIC SHIELD

[75] Inventors: David A. Fox, Shawnee Township, Allen County; Donal E. Baker, American Township, Allen County, both of Ohio

[73] Assignee: Westinghouse Electric Corp., Pittsburgh, Pa.

[21] Appl. No.: 427,331

[22] Filed: Sep. 29, 1982

[51] Int. Cl.[3] ..... H01F 15/04

[52] U.S. Cl. ..... 336/84 C; 336/69; 336/84 R; 336/229

[58] Field of Search ..... 336/69, 84 R, 84 C, 336/229

[56] References Cited

U.S. PATENT DOCUMENTS

| | | | |
|---|---|---|---|
| 3,146,417 | 8/1964 | Pearson | 336/84 C X |
| 3,149,296 | 9/1964 | Cox | 336/84 |
| 3,244,960 | 4/1966 | Stevens et al. | 336/84 C X |
| 3,292,127 | 12/1966 | Dormaier | 336/84 |
| 3,406,364 | 10/1968 | Russell et al. | 336/69 |
| 3,458,843 | 7/1969 | Lord | 336/84 |
| 3,503,126 | 3/1970 | Faller | 29/602 |

FOREIGN PATENT DOCUMENTS

| | | | |
|---|---|---|---|
| 207518 | 2/1924 | United Kingdom | 336/84 C |

*Primary Examiner*—J. V. Truhe
*Assistant Examiner*—Susan Steward
*Attorney, Agent, or Firm*—R. P. Lenhart

[57] ABSTRACT

A toroidal transformer is provided with an inner winding electrostatic shield formed by bringing together two conductive annular cups having a generally U-shaped radial cross section. The widths and radii of the sidewalls of these cups are dimensioned such that one of the sidewalls of the first cup forms a conductive interference fit with the corresponding sidewall of the second cup, while the other sidewall of the first cup is separated from the corresponding sidewall of the second cup by a gap, which prevents the shield from becoming a shorted turn. The shield formed by these two cups is placed around a wound core and a second winding is wound over the shield to form a transformer.

8 Claims, 3 Drawing Figures

TOROIDAL TRANSFORMER WITH ELECTROSTATIC SHIELD

BACKGROUND OF THE INVENTION

This invention relates to toroidal transformers and more particularly to an interwinding shield for minimizing the electrostatic coupling between primary and secondary windings of toroidal transformers.

Toroidal magnetic cores are frequently used in electronics because of their compact size, tight coupling and low flux leakage characteristics. Because of the close proximity between winding layers on the core required to achieve tight coupling, capacitance between the windings may be high. High interwinding capacitance may cause severe noise problems, particularly when the transformer is used to couple circuits with very steep voltage changes such as found in power inverters.

A common means of reducing the effect of winding capacitance is to place an electrostatic shield between windings to shunt capacitive coupled currents away from sensitive circuits. With normal cut or laminated cores with cylindrical openings, the shield may consist of a single layer of foil separated by two windings. Shielding a toroidal transformer is more difficult because of its shape. Since the electromagnetic induction between transformer windings must not be adversely effected by an electrostatic shield, the shield cannot constitute a short-circuited turn around a transformer winding. Known forms of toroidal transformer electrostatic shields include: a single close wound layer or wire with the start and finish of the winding open circuited, and a shield comprising two layers of metallic paint being separated by a narrow strip of insulating tape. The wound shield is subject to gaps between the turns which lessens its effectiveness while the painted shield adds complexity to the transformer assembly process. The present invention seeks to provide a toroidal transformer with a simple yet effective electrostatic shield between the windings.

SUMMARY OF THE INVENTION

An electrostatic shield for toroidal transformers constructed in accordance with the present invention comprises: a first annular conductive cup having a generally U-shaped radial cross-section formed by a base and two sidewalls; and a second annular conductive cup having a generally U-shaped radial cross-section formed by a base and a pair of sidewalls, wherein the first and second cups have interior and exterior sidewall widths and radii such that when the cups are axially aligned and brought together, one of the sidewalls of the first cup forms an interference fit with the corresponding sidewall of the second cup while a space is maintained between the other sidewall of the first cup and the corresponding sidewall of the second cup. This space prevents the shield from becoming a shorted turn and may be filled with an insulating material, such as tape. A toroidal transformer which utilizes this shield in accordance with the invention comprises: a toroidal core; a primary winding wound on the core; a shield formed by the above mentioned cup surrounding the wound core; and a secondary winding wound on the electrostatic shield.

On another level, this invention also encompasses a method of making a toroidal transformer having an electrostatic shield between the windings, comprising the steps of: wrapping a first winding on a toroidal transformer core; placing a first conductive annular cup having a generally U-shaped radial cross-section formed by a base and two sidewalls, on said wound core; placing an insulating material adjacent one of the sidewalls of the annular cup; placing a second conductive annular cup having a generally U-shaped radial cross-section formed by a base and two sidewalls, on said wound core such that the bases of the first and second cups are on opposite sides of the wound core, wherein one of the sidewalls of the second cup overlaps and makes electrical contact with the corresponding sidewall of the first cup while the other sidewall of the second cup is separated from the corresponding sidewall of the first cup by the insulating material; and wrapping a second winding on the electrostatic shield formed by the first and second annular cup.

DESCRIPTION OF THE PREFERRED EMBODIMENTS

Figure 1:
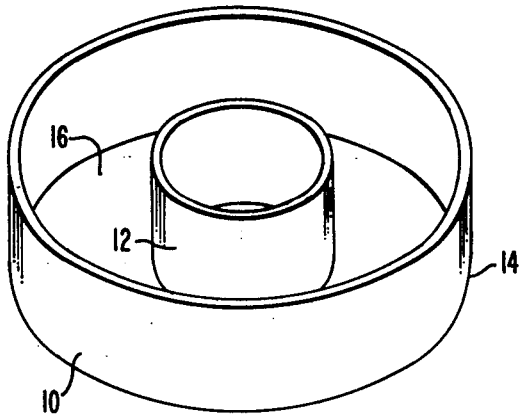
FIGS. 1 and 2 are perspective views of conductive annular cups used to form a toroidal transformer electrostatic shield in accordance with one embodiment of the present invention.
Figure 2:
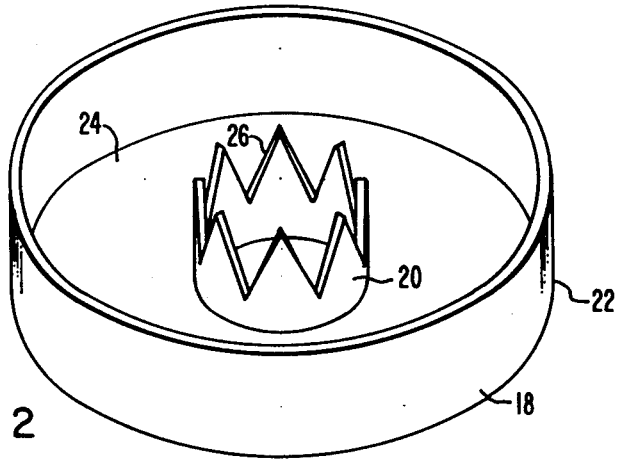

Referring to the drawings, FIG. 1 is a perspective view of a conductive annular cup having a generally U-shaped radial cross-section formed by a pair of sidewalls 12 and 14 and a base 16. FIG. 2 is a perspective view of a second conductive annular cup having a generally U-shaped radial cross-section formed by sidewalls 20 and 22 and base 24. A plurality of discrete pointed projections 26 extend from the edge of sidewall 20 to insure good electrical contact between sidewalls 12 and 20 when the conductive cups of FIGS. 1 and 2 are axially aligned and brought together to form the electrostatic shield. The interior nd exterior sidewall widths and radii of the cups of FIGS. 1 and 2 are such that when the cups are axially aligned and brought together, sidewalls 12 and 20 overlap to form an electrically conductive interference fit while a gap is maintained between sidewalls 14 and 22. When the shield is constructed, means for insulating sidewalls 14 and 22, such as insulating tape, may be contained within this gap. Discrete pointed projections 26 on sidewall 20 improve the electrical contact formed by the interference fit of sidewalls 12 and 20.

Figure 3:
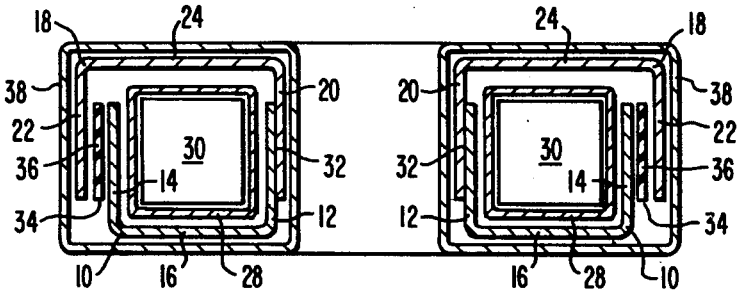
FIG. 3 is a cross-sectional view of a toroidal transformer having an electrostatic shield constructed in accordance with the present invention.

FIG. 3 is a cross-sectional view of an electrostatically shielded toroidal transformer constructed in accordance with one embodiment of the present invention. A first, or primary winding is wound around a toroidal ferromagnetic core 30. Conductive annular cups 10 and 18 have been axially aligned and brought together from different sides of the core to form an electrostatic shield around the wound core. The inner sidewalls 12 and 20 of cups 10 and 18 form an electrically conductive interference fit 32, while sidewalls 14 and 22 are spaced to form an annular gap 34. An insulating means such as insulating tape 36 is disposed within gap 34 to prevent the shield from becoming a shorted turn. A second winding, or secondary is wound around the shield formed by cups 10 and 18.

The transformer of FIG. 3 is constructed according to a method which includes the steps of: wrapping a first winding 28 around a toroidal ferromagnetic core 30; placing a first conductive annular cup 10 having a generally U-shaped radial cross-section formed by a base 16 and two sidewalls 12 and 14, on the wound core; placing an insulating material 36 adjacent one of the sidewalls of the first annular cup 10; placing a second conductive annular cup 18 having a generally U-shaped radial cross-section formed by a base 24 and sidewalls 20 and 22, on the wound core such that the bases 16 and 24 of annular cups 10 and 18 are on opposite sides of the wound core, wherein sidewalls 12 and 20 overlap and make electrical contact while sidewalls 14 and 22 overlap but are separated by insulating material 36; and wrapping a second winding 38 on the electrostatic screen formed by conductive annular cups 10 and 18.

The conductive annular cups used to form the electrostatic shield of this invention can be constructed of suitable conductive material such as aluminum or copper foil, having a thickness of a few mils. An electrical connection may be made to the shield by soldering, crimping, or by taping a bare wire to one of the cups. A taped connection will be securely held in place by the pressure of the secondary winding. A current coupled signal transformer having a measured interwinding capacitance of 175 picofarads, was fitted with a 4 mil aluminum shield in accordance with this invention, whereby the interwinding capacitance was reduced to two picofarads.

While this invention has been described in terms of what is at present believed to be the preferred embodiment, it will be apparent to those skilled in the art that various changes and modifications my be made to the transformer and shield structure without departing from the scope of the invention. For example, sidewalls 14 and 22 of cups 10 and 18 may be made to form a conductive interference fit while sidewalls 12 and 20 are spaced and insulated to prevent the shield from becoming a shorted turn. It is therefore intended that the appended claims cover all such changes and modifications that may occur within the scope of this invention.

What is claimed is:

1. An electrostatic shield for toroidal transformers, comprising:

a first annular conductive cup having a generally U-shaped radial cross-section;

a second annular conductive cup having a generally U-shaped radial cross-section;

said first and second annular cups having interior and exterior sidewall widths and radii such that when said cups are axially aligned and brought together, a first one of the sidewalls of said first cup forms an interference fit with the corresponding sidewall of said second cup while a space is maintained between a second one of the sidewalls of said first cup and the corresponding sidewall of said second cup.

2. An electrostatic shield for a toroidal transformer as recited in claim 1, further comprising:

means for electrically insulating said second one of said sidewalls of said first cup from said corresponding sidewall of said second cup.

3. An electrostatic shield for a toroidal transformer as recited in claim 2, wherein:

said second one of said sidewalls of said first cup and said corresponding sidewall of said second cup form an overlapping clearance fit with said insulating means being disposed within said overlapping fit.

4. An electrostatic shield for a toroidal transformer as recited in claim 2, wherein said first one of the sidewalls of said first cup comprises:

a plurality of discrete pointed projections extending from the edge of said first sidewall of said first cup.

5. A shielded toroidal transformer comprising:

a toroidal core;

a primary winding wound on said core;

an electrostatic shield disposed around said primary winding, said shield comprising, a first annular conductive cup having a generally U-shaped radial cross-section, a second annular conductive cup having a generally U-shaped radial cross-section, wherein said first and second annular cups have interior and exterior sidewall widths and radii such that when said cups are axially aligned and brought together, a first one of the sidewalls of said first cup forms an interference fit with the corresponding sidewall of said second cup while a space is maintained between a second one of the sidewalls of said first cup and the corresponding sidewall of said second cup; and a secondary winding wound on said electrostatic shield.

6. A shielded toroidal transformer as recited in claim 5 further comprising:

means for electrically insulating said second one of said sidewalls of said first cup from said corresponding sidewall of said second cup.

7. A shielded toroidal transformer as recited in claim 6, wherein:

said second one of said sidewalls of said first cup and said corresponding sidewall of said second cup form an overlapping clearance fit with said insulating means being disposed within said overlapping fit.

8. A shielded toroidal transformer as recited in claim 6, wherein said first one of the sidewalls of said first cup comprises:

a plurality of discrete pointed projections extending from the edge of said first sidewall of said first cup.

* * * * *